US007243385B2

(12) United States Patent
Lampkins

(10) Patent No.: US 7,243,385 B2
(45) Date of Patent: Jul. 17, 2007

(54) PROTECTIVE BEDDING SYSTEM

(76) Inventor: Gary W. Lampkins, 1501 Aragea Blvd., Ft Washington, MD (US) 20744

( * ) Notice: Subject to any disclaimer, the term of this patent is extended or adjusted under 35 U.S.C. 154(b) by 68 days.

(21) Appl. No.: 11/235,252

(22) Filed: Sep. 27, 2005

(65) Prior Publication Data

US 2007/0067909 A1 Mar. 29, 2007

(51) Int. Cl.
*A47G 9/04* (2006.01)
*A47G 9/02* (2006.01)

(52) U.S. Cl. ..... 5/484; 5/482; 5/490; 5/496; 5/502

(58) Field of Classification Search ..... 5/484, 5/490, 482, 413 R, 496, 502
See application file for complete search history.

(56) References Cited

U.S. PATENT DOCUMENTS 2,498,055 A * 2/1950 Veit ..... 5/485
2,641,001 A * 6/1953 Krasnov ..... 5/499
2,963,715 A * 12/1960 Young ..... 5/497
5,321,861 A * 6/1994 Dancey et al. ..... 5/482
5,548,858 A * 8/1996 Shoa ..... 5/413 R
5,566,410 A * 10/1996 Schaechter ..... 5/490
6,049,925 A * 4/2000 Lewis ..... 5/497
D430,768 S * 9/2000 Hindes ..... D6/601

* cited by examiner

*Primary Examiner*—Alexander Grosz

(57) ABSTRACT

A portable sheet, comforter and pillow cover apparatus whose embodiment members of a top and bottom sheet coupled together, with an incorporation of a protective ply member attached to the top and bottom sheet, whose purpose is to shield and protect an individual from harmful body organisms that are commonly found, and contaminated by prior occupants, in hotels or any other frequently used beds and bedding materials. Moreover, the design and enclosed features of the apparatus will give an individual user a piece of mind bought on by sanitary sleeping arrangements without sacrificing the comfort of the accommodation sought.

2 Claims, 3 Drawing Sheets

PROTECTIVE BEDDING SYSTEM

BACKGROUND OF THE INVENTION

The present invention relates to an apparatus, namely a sheet, comforter and pillow cover, which is designed to provide a sanitary sleeping environment away from home. The sheet cover will also necessitate comfort and ease of mind by ensuring that the remnants of disease, bacteria, viruses and body contaminates which may be present from past occupants, will not come in contact with the individual utilizing the enclosed apparatus.

DESCRIPTION OF PRIOR ART

U.S. Pat. No. 6,049,925 Lewis discloses a one piece sheet set that couples a bottom and top sheet together as well as a pillow case member that is attached to the bottom sheet to hold a pillow stationary on the bed. Lewis by design may be construed as an improvement to prior art such as U.S. Pat. No. 5,177,821 Kawtoski which displays a fitted bed sheet that through its embodiment members, maintains the fitting of said sheet about the mattress. In the prior art just discussed a limitation of fit to different bed sizes exist because of the obvious requirement of prior knowledge of the dimension of the specified mattress; moreover the design of Lewis with the attachment of a pillow holding means may cause a danger to infants and/or small children as well as limit pillow adjustment for comfort and/or position.

U.S. Pat. No. 6,539,565 Trimble discloses a sheet construction with a pillow pouch along with flaps that engage and attach said sheet to the underneath portion of a mattress. Further it includes an auxiliary panel that fits over the bottom fitted sheet, while tucking underneath said mattress as well. Trimble just as the aforementioned Lewis, present a danger to infants and small children, in addition to a requirement of removing the mattress to a large degree to fully engage the apparatus. Moreover, the pillow pouch creates a limitation of pillow adjustment and comfort, coupled with a possible hazard for small children to get limbs entangled.

U.S. Pat. No. 5,548,858 Shoa displays a disposable sleeping bag for use on a bed or cot made of soft paper which also has an apron for the writing of messages or the keeping of vital records etc. Shoa's design also includes a pillow pouch attachment to maintain a pillow and its position, with a further use of preventing the user from coming in bodily contact with a frequently used bed for the obvious sanitary reasons. Although Shoa addresses a need for sanitary means in high volume beds such as hospitals and hotels, it also exhibits short comings of practicality and design, such as the uncomfortable feeling of paper, along with the crumpling and rattling noise that is inherit when moving on or about paper, namely within said sleeping bag, as well as a limitation of pillow adjustment for comfort, and the difficulty of getting feet and legs in and out of said sleeping bag if constructed in step with its proposed design.

U.S. Pat. No. 3,857,124 Hadley which comprises of a bottom releasable sheet and a top sheet combined with a bedspread, with a zipper or slide fasteners means to secure the top sheet with the bottom, also include some of the same drawbacks in prior art heretofore mentioned, namely a disregard for the safety of infants and small children, and a difficulty of getting in and out of the bed when the apparatus is engaged as designed, and more importantly, the absence of a practical means upon which said device can be used effectively.

SUMMARY OF THE INVENTION

The sheet, comforter, pillow cover apparatus represents a practical means upon which to protect an individual from the presence of unseen, and therefore, unknown bacteria viruses, disease, infectious body fluids and excrement which are commonly found in frequently used bedding, mainly hotel accommodations. An apparatus such as this is desperately needed to protect the public at large from the spread and prevention of said harmful bodies. Hence, the sheet, comforter and pillow cover apparatus through its embodiments, will provide a sanitary and safe environment means upon which an individual may use hotel accommodations with a limited possibility of infection, by or through transmittal of the harmfull body organisms herein mentioned, that may be present by way of previous occupants.

BRIEF DESCRIPTION OF THE DRAWINGS

The apparatus contained herein will be clearly understood when referenced by the drawings containing the preferred embodiments wherein:

FIG. 1. is a side view of the apparatus and preferred embodiments, with

FIG. 2. illustrating a top view of the apparatus, with

DESCRIPTION OF THE PREFERRED EMBODIMENTS

Figure 1:
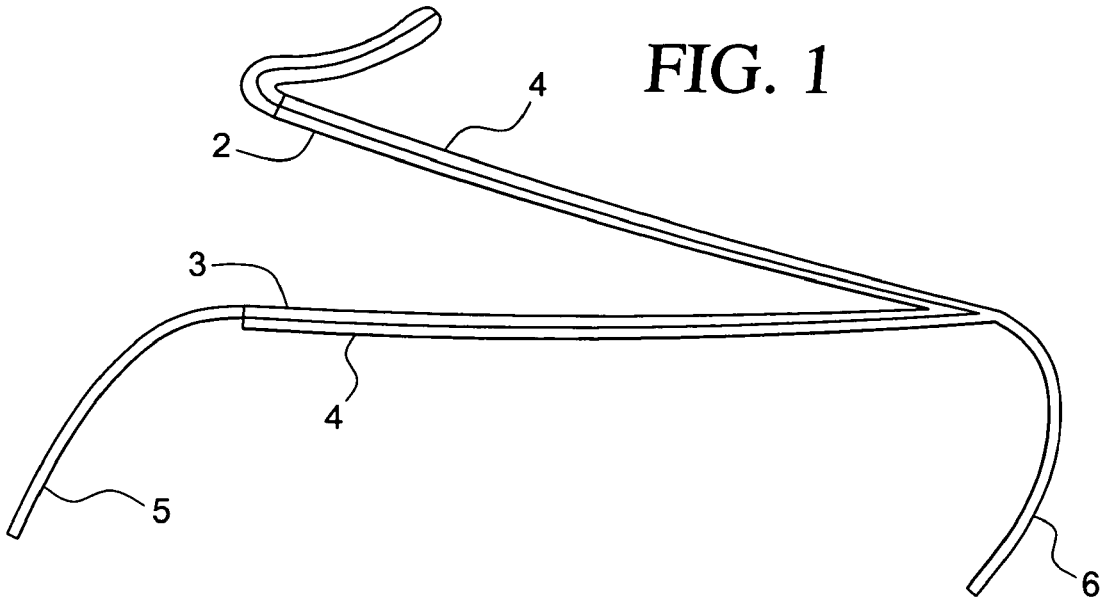
Figure 2:
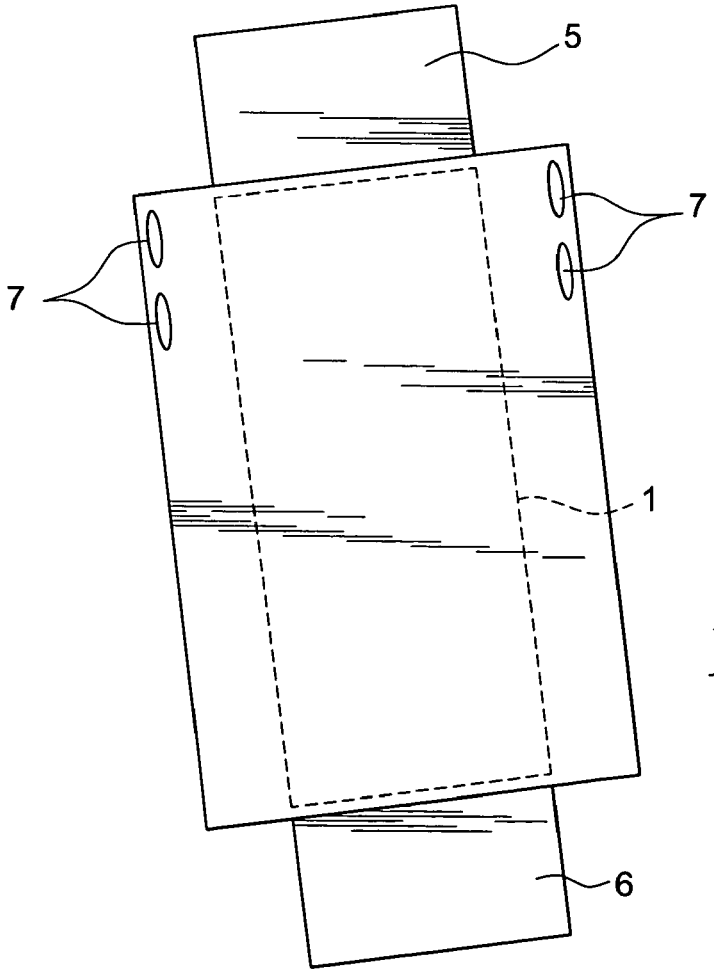
Figure 3:
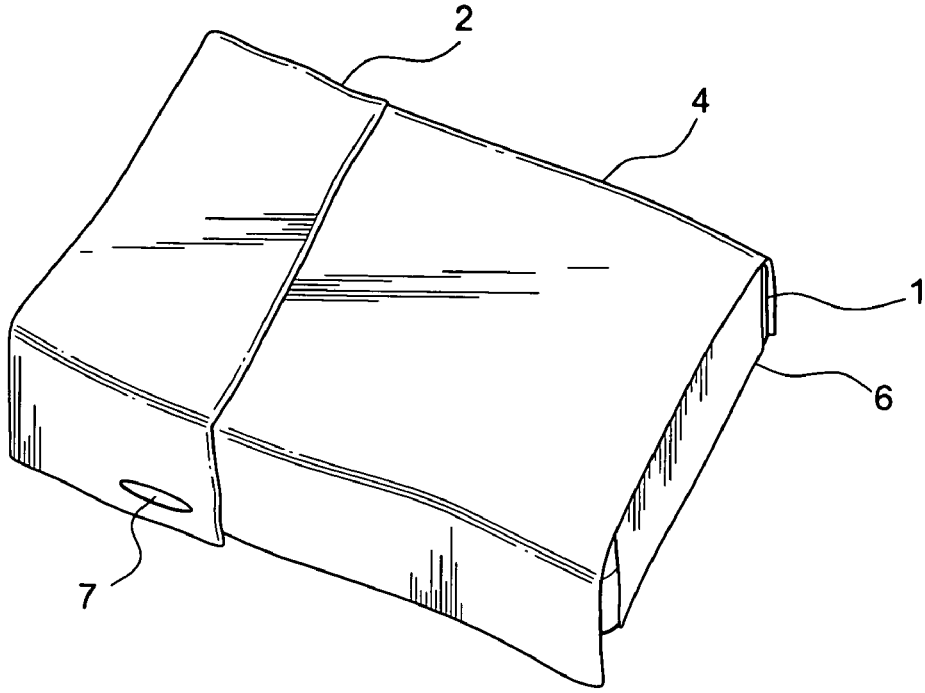
FIG. 3. being a top angled view of the apparatus as it will appear on a mattress, with FIG. 4. being a side view of the apparatus with its preferred embodiments resting on top of a mattress, box spring and comforter, with FIG. 5. being a side view of the protective ply in relation to its position of being on top of the top sheet and under the bottom sheet, with FIG. 6. being a side view of a pillow pouch which houses a potential pillow, and with FIG. 7. being an angled top view of the pillow pouch with a pillow inside.
Figure 4:
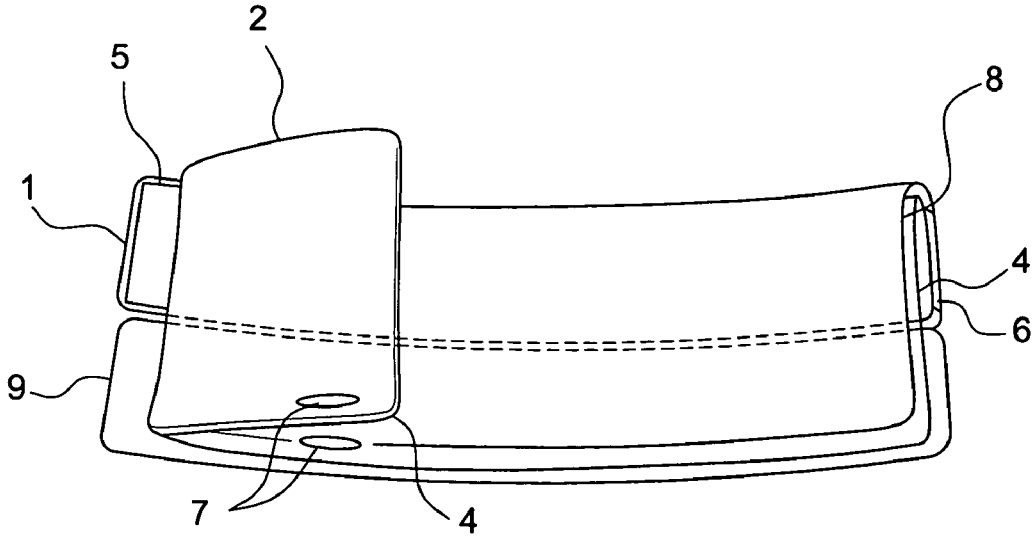
Figure 5:
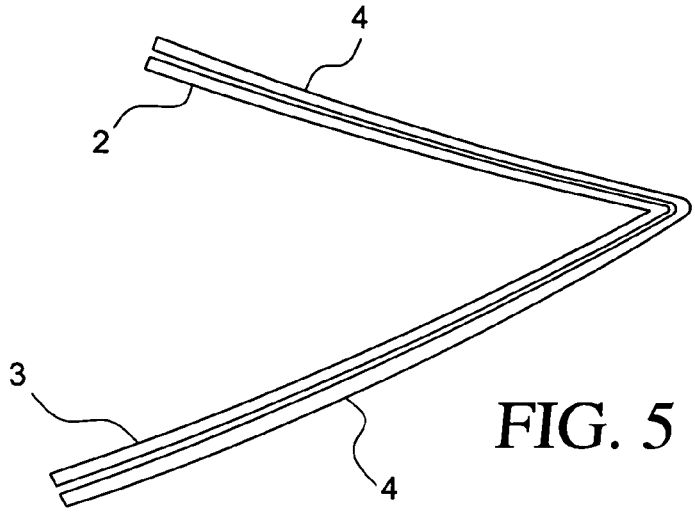
Figure 6:
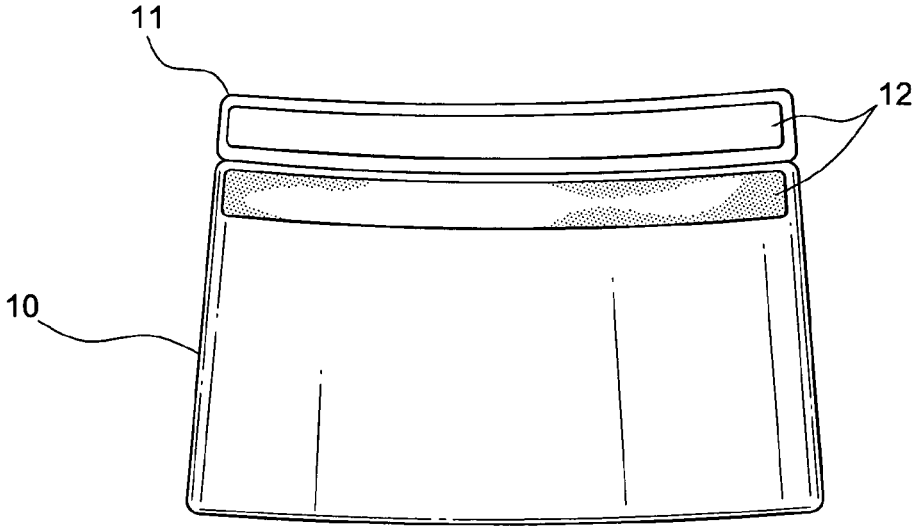
Figure 7:
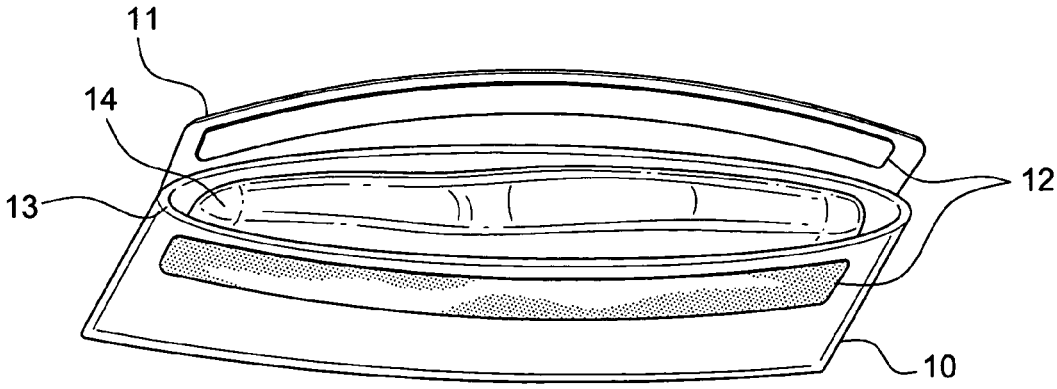

The apparatus includes a top sheet 2 and a bottom sheet 3 that is coupled together at one end to form a barrier under, over and around an individual when placed on top of a mattress 1 covered by a bed sheet and underneath the comforter 8 of a bed. The protective ply 4 is attached to the top of the top sheet 2 and to the bottom of the bottom sheet 3 to form a protective, water proof barrier, which will limit contact with the underneath portion of a comforter 8 and the top of a community bed sheet that is fitted on a mattress 1. A community bed sheet is considered the bed sheet which is fitted on the mattress, and upon which the body protective bedding apparatus of the invention is to be used. The protective ply 4 is attached and made a part of the top and bottom sheets 2 and 3 by stitching, by Velcro fasteners, (T.M. of American Velcro Inc.) or a cloth adhesive. Furthermore, its composition may be of a flexible, water-proof material, be it plastic, cloth or other, that has been proven to provide an effective, protective and non penetrating property barrier that will prevent contact of said comforter 8 and bed sheet that may contain bacteria, viruses, infectious organisms, excrement and body fluids with top sheet 2 and bottom sheet 3. To engage and hold the apparatus in place, first the comforter 8 must be pulled back to expose the entire top surface of the community bed sheet fitted on a mattress 1. The apparatus is laid on top of the exposed community bed sheet with the foot flap 6 being tucked at the bottom, under and in-between the mattress 1 and the box spring 9, while the header flap 5 is tucked under and in between at the head of the mattress 1 and the box spring 9. This will anchor and secure the device to its host mattress 1. Once the apparatus is secured and in place as specified, the comforter 8 will be pulled back up and on top of the apparatus so as to allow the comforter 8 to serve its intended purpose of providing warmth and comfort. When the comforter 8 is pulled back up in its made position, thus covering the entire apparatus and mattress 1, the top sheet 2 and the comforter 8 is folded back, with the top sheet 2 engaging the cooperating fastening or locking means 7 which may be constructed of Velcro fasteners (T.M. of American Velcro Inc.). The folding back of the top sheet 2 with the protective ply 4 made a part thereof will provide a protective barrier over the top of the comforter 8 and its potential contaminants and the inner portion of top sheet 2. The locking means 7 will maintain the desired position of the top sheet 2 and protective ply 4 while at rest on top of and covering the top portion of the comforter 8. The width of the apparatus is as such as to prevent an individual from coming in contact with the community sheet fitted on a mattress 1 and box spring 9, as well as the entire under surface of the comforter 8. The top and bottom sheet 2 and 3 are not attached or coupled together on the sides like a sleeping bag or the like so that ingress and egress of the device and host bedding is made as normal, uninhibited, and natural as possible. The pillow pouch 10 is incorporated to fit a standard size pillow 14 into its pouch for the same reason as the sheet and comforter portion of the apparatus is incorporated on in a bed, which is, to shield an individual from contact with unhealthy, threatening body contaminates that may be present by way of previous users. The pillow pouch 10 also incorporates a protective ply 13 attached to and made a part of the inner portion of said pillow pouch 10. The pillow pouch protective ply 13 serves the same purpose as the protective ply 4 does with the sheet, comforter portion of the apparatus. Once the pillow 14 is inserted into the pillow pouch 10 the pouch flap 11 is folded down covering the entire pillow 14 thereby sealing it in by engaging the pillow pouch closing means 12, which preferably, may also consist of Velcro fasteners (T.M. of American Velcro Inc.). These embodiments will ensure non contact of the host pillow 14 with an individual users head. Moreover, this feature will allow the user to position and maneuver the now enclosed pillow 14 within the pillow pouch 10 to wherever and however is deemed necessary to obtain the desired level of comfort sought by the individual user. The apparatus as a whole with its water proofing qualities will also serve as a protective sheet, mattress and comforter measure in case of bed wetting or the like. This ironically, will preclude the host bedding from being contaminated by disease or bacteria or any other harmful, unhealthy body fluids or organisms heretofore mentioned, by through an individual user from the inside out as well.

I claim:

1. A body protective bedding apparatus, adapted to envelop and protect a user from contact with an underlying bed sheet and an overlying comforter, comprising of:

a top and bottom sheet, each sheet comprising two sides and two ends, said sheets coupled together at one end and unconnected to each other at the sides and the other end, with a protective waterproof ply member (4) covering and attached to the top of the top sheet (2), and to the bottom of the bottom sheet (3), with mattress securing flap members (5, 6) attached at both ends of the bottom sheet (3), a retaining, locking or fastening means (7) on both sides of the protective ply (4), allowing said top sheet with the protective ply (4) attached thereto, to fold back over comforter and engage its means of locking (7) on both sides of the protective ply (4), whereby contact by the user with the comforter is inhibited;

a pillow pouch member comprising of an outer ply with a protective ply member attached to the inner portion of said pouch, a flap member having one of two portions of a locking or fastening means on the inside of said flap and the other portion of said locking or fastening means on the front top body of the outer of said pouch, whereby upon the insertion of the pillow in the pouch, and the engagement of the fastening means, a user is prevented from contact with the pillow.

2. A protective bedding apparatus of claim 1, wherein the protective ply members are made of a synthetic film or plastic.

* * * * *